US009063497B2

(12) United States Patent
Katagiri et al.

(10) Patent No.: US 9,063,497 B2
(45) Date of Patent: Jun. 23, 2015

(54) IMAGE FORMING APPARATUS HAVING A POWER SUPPLY COMMON TO PRIMARY TRANSFER AND SECONDARY TRANSFER

(71) Applicant: CANON KABUSHIKI KAISHA, Tokyo (JP)

(72) Inventors: Shinji Katagiri, Yokohama (JP); Yuji Kawaguchi, Tokyo (JP); Masaru Ohno, Ebina (JP); Satoshi Takami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 13/834,762

(22) Filed: Mar. 15, 2013

(65) Prior Publication Data

US 2013/0259543 A1 Oct. 3, 2013

(30) Foreign Application Priority Data

Apr. 3, 2012 (JP) ..... 2012-085029
Mar. 13, 2013 (JP) ..... 2013-050225

(51) Int. Cl.
*G03G 15/01* (2006.01)
*G03G 15/16* (2006.01)
*G03G 15/00* (2006.01)

(52) U.S. Cl.
CPC ..... *G03G 15/5004* (2013.01); *G03G 15/1605* (2013.01); *G03G 15/1675* (2013.01)

(58) Field of Classification Search
CPC ..... G03G 15/80; G03G 15/5004; G03G 15/1605; G03G 15/1675
USPC ..... 399/66, 90, 121, 297, 302, 308
See application file for complete search history.

(56) References Cited

U.S. PATENT DOCUMENTS

| | | | | |
|---|---|---|---|---|
| 5,809,387 | A * | 9/1998 | Takeuchi et al. | 399/302 |
| 6,144,817 | A * | 11/2000 | Takeuchi et al. | 399/51 |
| 6,421,521 | B2 * | 7/2002 | Tanaka | 399/299 |
| 6,966,542 | B2 * | 11/2005 | Bettencourt | 254/131 |
| 7,228,085 | B2 | 6/2007 | Shin | |
| 2001/0031160 | A1 * | 10/2001 | Tanaka | 399/298 |
| 2001/0051056 | A1 * | 12/2001 | Noguchi et al. | 399/66 |
| 2007/0231023 | A1 * | 10/2007 | Miyazaki | 399/302 |
| 2012/0177392 | A1 * | 7/2012 | Murayama | 399/66 |
| 2013/0259506 | A1 * | 10/2013 | Katagiri et al. | 399/66 |

FOREIGN PATENT DOCUMENTS

| | | | |
|---|---|---|---|
| JP | 2001175092 | A | 6/2001 |
| JP | 2006259640 | A | 9/2006 |
| JP | 2010085593 | A | 4/2010 |

* cited by examiner

*Primary Examiner* — Francis Gray
(74) *Attorney, Agent, or Firm* — Canon USA, Inc., IP Division

(57) ABSTRACT

In existing image forming apparatuses, it is difficult to maintain each of a primary transfer member and a secondary transfer member at an optimum potential.

An image forming apparatus includes a voltage maintenance element connected to a secondary transfer counter roller and a primary transfer member. The voltage maintenance element maintains each of the secondary transfer counter roller and the primary transfer member at a predetermined potential or higher. By using the voltage maintenance element, each of a secondary transfer roller and the primary transfer member is set to an optimum potential by a single transfer power supply.

16 Claims, 11 Drawing Sheets

IMAGE FORMING APPARATUS HAVING A POWER SUPPLY COMMON TO PRIMARY TRANSFER AND SECONDARY TRANSFER

BACKGROUND OF THE INVENTION

1. Field of the Invention

The present invention relates to an electrophotographic image forming apparatus, such as a copier or a printer.

2. Description of the Related Art

Electrophotographic image forming apparatuses including an image bearing member and an intermediate transfer member have been developed. Such an existing image forming apparatus applies a voltage from a voltage power source (a power circuit) to a primary transfer member disposed so as to face the image bearing member with the intermediate transfer member therebetween. Thus, the image forming apparatus generates a primary transfer potential in a primary transfer section in which the intermediate transfer member is in contact with the image bearing member. In this manner, by using a potential difference formed between the image bearing member and the intermediate transfer member, the image forming apparatus primarily transfers a toner image formed on a surface of the image bearing member onto the intermediate transfer member (a primary transfer step). Subsequently, the primary transfer step is repeated for each of toner colors. In this manner, toner images having different colors are formed on the surface of the intermediate transfer member. Thereafter, a second transfer step is performed. In the second transfer step, the toner images having different colors and formed on the surface of the intermediate transfer member are simultaneously secondarily transferred onto a surface of a recording medium (e.g., a sheet of paper) by applying a secondary transfer voltage to the secondary transfer member. Thereafter, the toner images that are simultaneously transferred are fixed to the recording medium using a fixing unit.

Japanese Patent Laid-Open No. 2001-175092 describes the following structure. That is, a belt is used as the intermediate transfer member (hereinafter referred to as an "intermediate transfer belt"). A transfer power supply for primary transfer is connected to one of a stretching member that keeps the inner circumferential surface of the intermediate transfer belt tight and the primary transfer member. By passing an electric current in the circumferential direction of the intermediate transfer belt, a voltage is applied from a single transfer power supply to a plurality of primary transfer members.

However, in Japanese Patent Laid-Open No. 2001-175092, a power supply for primary transfer and a power supply for secondary transfer are provided so as to be independent from each other. That is, the power supply for primary transfer and the power supply for secondary transfer are not made common.

SUMMARY OF THE INVENTION

The present invention provides an image forming apparatus that allows a power supply for primary transfer and a power supply for secondary transfer to be common.

According to an embodiment of the present invention, an image forming apparatus includes a plurality of image bearing members each bearing a toner image, a movable conductive intermediate transfer belt configured to allow the toner image to be primarily transferred from each of the image bearing members thereonto, a primary transfer member configured to primarily transfer the toner image from each of the image bearing members onto the intermediate transfer belt, where the primary transfer member is in contact with a primary transfer surface of the intermediate transfer belt that has the toner image transferred thereonto, a secondary transfer member in contact with the intermediate transfer belt, where the secondary transfer member forms a secondary transfer section together with the intermediate transfer belt, a secondary transfer counter member disposed so as to face the secondary transfer member with the intermediate transfer belt therebetween in the secondary transfer section, and a voltage maintenance element connected to the primary transfer members and the secondary transfer counter member. The secondary transfer counter member and the primary transfer members, to which the voltage maintenance element is connected, are maintained at a predetermined voltage or higher by a current flowing from the secondary transfer member to the secondary transfer counter member via the intermediate transfer belt.

Further features of the present invention will become apparent from the following description of exemplary embodiments with reference to the attached drawings.

DESCRIPTION OF THE EMBODIMENTS

Exemplary embodiments of the present invention are described in detail below with reference to the accompanying drawings. Note that the sizes, the materials, and the shapes of components of the following exemplary embodiments, and the relative positional relationship among the components can be changed in accordance with the configuration and conditions of the apparatus of the invention. Therefore, the scope of the invention should not be construed as being limited by the components or their configuration as described in the following embodiments, if not otherwise specified.

First Exemplary Embodiment

Figure 1:
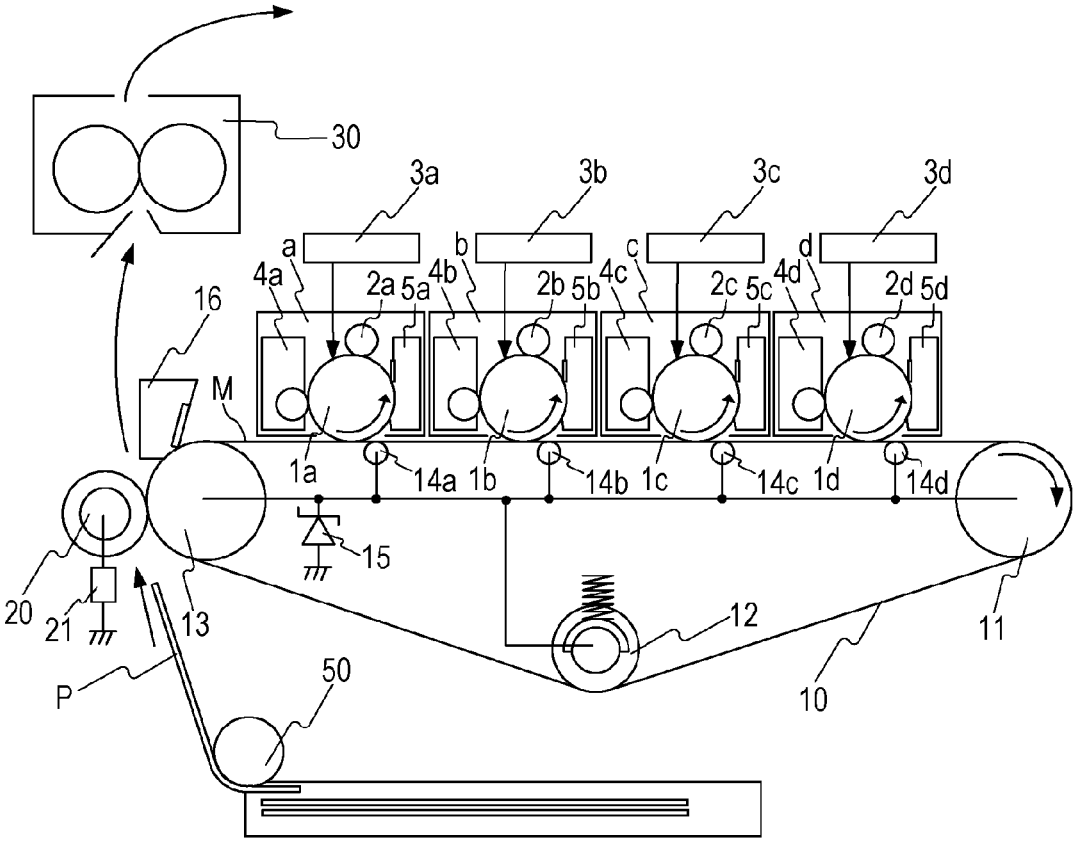
FIG. 1 is a schematic illustration of an image forming apparatus according to a first exemplary embodiment.

FIG. 1 is a schematic illustration of an exemplary color image forming apparatus. The configuration of an image forming apparatus according to the present exemplary embodiment and the operation performed by the image forming apparatus are described below with reference to FIG. 1. Note that the image forming apparatus according to the present exemplary embodiment is of a tandem type and includes first to fourth image forming stations a to d. The first image forming station a forms a yellow (Y) image. The second image forming station b forms a magenta (M) image. The third image forming station c forms a cyan (C) image. The fourth image forming station d forms a black (Bk) image. The image forming stations have the same configuration except for the colors of toner contained therein. Accordingly, the following description is made with reference to only the first image forming station a.

The first image forming station a includes a drum-shaped elecrophotographic photoconductor 1*a* (hereinafter referred to as a "photoconductor drum 1*a*", a charge roller 2*a* that serves as a charging member, a development unit 4*a*, and a cleaning device 5*a*. The photoconductor drum 1*a* serves as an image bearing member that bears a toner image and rotates in a direction indicated by an arrow at a predetermined circumferential speed (a predetermined process speed).

The development unit 4*a* contains yellow toner and develops an image on the photoconductor drum 1*a* with the yellow toner. The cleaning device 5*a* collects toner deposited on the photoconductor drum 1*a*. According to the present exemplary embodiment, the cleaning device 5*a* includes a cleaning blade serving as a cleaning member that is in contact with the photoconductor drum 1*a* and a waste toner box that contains the toner collected by the cleaning blade.

Upon receiving an image signal, a controller 100 starts an image forming operation. The photoconductor drum 1*a* is rotatingly driven. During its rotation, the photoconductor drum 1*a* is uniformly charged into a predetermined potential of a predetermined polarity (a negative polarity according to the present exemplary embodiment) by the charge roller 2*a*. Thereafter, the photoconductor drum 1*a* is exposed to light in accordance with the image signal by an exposure unit 3*a*. In this manner, an electrostatic latent image corresponding to a yellow color component image of a desired color image is formed. Subsequently, the electrostatic latent image is developed at a development position by the development unit 4*a* (the yellow development unit). Thus, the image is made into a visible yellow toner image. At that time, a normal charge polarity of the toner contained in the development unit 4*a* has a negative polarity. According to the present exemplary embodiment, reversal development is employed. In the reversal development, an electrostatic latent image is developed with toner having a charge polarity that is the same as the charge polarity of the photoconductor drum charged by the charging member. However, the present exemplary embodiment is applicable to electrophotographic apparatuses employing positive development in which an electrostatic latent image is developed using toner having a charge polarity opposite to the charge polarity of the photoconductor drum.

An intermediate transfer belt 10 is entrained around a plurality of stretching members 11, 12, and 13. The intermediate transfer belt 10 is movable in a direction that is the same as the moving direction of the photoconductor drum 1*a* in a contact portion in which the intermediate transfer belt 10 faces and is in contact with the photoconductor drum 1*a*. At that time, the circumferential speeds of the intermediate transfer belt 10 and the photoconductor drum 1*a* are substantially the same. When the yellow toner image formed on the photoconductor drum 1*a* passes through the contact portion between the photoconductor drum 1*a* and the intermediate transfer belt 10 (hereinafter referred to as a "primary transfer section"), the yellow toner image is transferred onto the intermediate transfer belt 10 due to a potential difference generated between the photoconductor drum 1*a* and the intermediate transfer belt 10 (primary transfer). Hereinafter, the potential of the intermediate transfer belt 10 generated in the primary transfer section is referred to as "primary transfer potential". A method for generating the primary transfer potential according to the present exemplary embodiment is described in more detail below.

Primary-transfer remaining toner that remains on the surface of the photoconductor drum 1*a* is cleaned (removed) by the cleaning device 5*a*. Thereafter, the cleaned photoconductor drum 1*a* is subjected to the following image forming process starting from a charging operation.

Similarly, a magenta (second color) toner image, a cyan (third color) toner image, and a black (fourth color) toner image are formed by the second, third, and fourth image forming stations b, c, and d, respectively. Each of the toner images is sequentially placed on top of one another on the intermediate transfer belt 10 in the primary transfer section for the color. Through the above-described steps, a full color image corresponding to a desired color image can be obtained.

The four color toner images on the intermediate transfer belt 10 are simultaneously transferred onto a surface of a recording medium P fed from a sheet feeding unit 50 when passing through a secondary transfer section formed between the intermediate transfer belt 10 and a secondary transfer roller 20 (secondary transfer). The secondary transfer roller 20 serves as the secondary transfer member. The secondary transfer roller 20 includes a nickel-plated steel bar that is covered by a foam sponge member consisting primarily of nitrile butadiene rubber (NBR) and an epichlorohydrin rubber. The secondary transfer roller 20 has an outer diameter of 18 mm. The nickel-plated steel bar has an outer diameter of 8 mm. The thickness of the foam sponge member is set to 5 mm. The foam sponge member has a volume resistivity of $10^8$ Ω·cm. The secondary transfer roller 20 is in pressure contact with the outer peripheral surface of the intermediate transfer belt 10. The applied pressure is 50 N. In this manner, the secondary transfer section is formed. The secondary transfer roller 20 is driven and rotated by the intermediate transfer belt 10. When the toner on the intermediate transfer belt 10 is secondarily transferred to the recording medium P, such as a sheet of paper, a voltage of 1600 V serving as the secondary transfer voltage is applied from a transfer power supply 21 to the secondary transfer roller 20.

The transfer power supply 21 includes a transformer that generates a voltage. The transfer power supply 21 supplies the secondary transfer voltage to the secondary transfer roller 20. The secondary transfer voltage output from the transformer is controlled by a control unit (not illustrated) (e.g., the controller) so as to be substantially constant. In addition, the transfer power supply 21 can apply a voltage in the range from 100 V to 4000 V.

Subsequently, the recording medium P that bears the four color toner images is moved into a fixing unit 30. By applying heat and pressure to the four color toner images in the fixing unit 30, the four-color toner are fused and mixed. Thus, the toner images are fixed to the recording medium P. The toner left on the intermediate transfer belt 10 after the secondary transfer is cleaned and removed by a cleaning unit 16. Through the above-described processes, a full color print image is formed.

Figure 2:
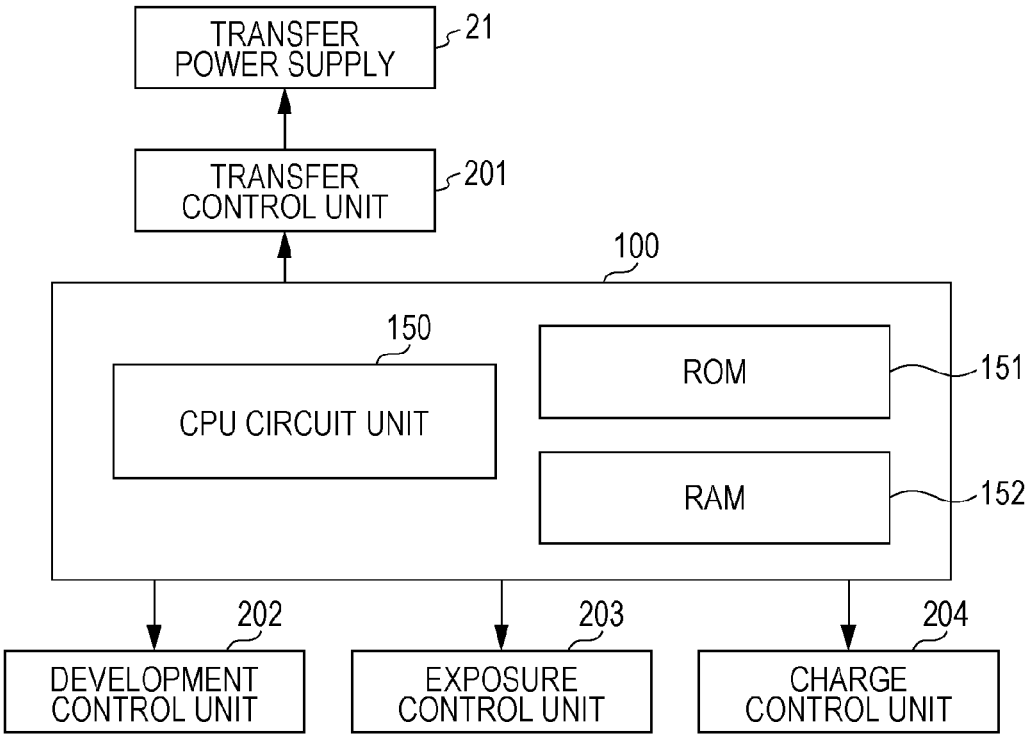
FIG. 2 is a block diagram of control units of the image forming apparatus.

An exemplary configuration of the controller 100 that performs overall control of the image forming apparatus is described next with reference to FIG. 2. As illustrated in FIG. 2, the controller 100 includes a CPU circuit unit 150. The CPU circuit unit 150 includes a read only memory (ROM) 151 and a random access memory (RAM) 152. The CPU circuit unit 150 performs overall control of a transfer control unit 201, a development control unit 202, an exposure control unit 203, and a charge control unit 204 in accordance with a control program stored in the ROM 151. An environment table and a paper thickness table are stored in the ROM 151. A CPU reads the tables and uses the table for its control. The RAM 152 temporarily stores control data. In addition, the RAM 152 is used as a work area of a computing process for control. The transfer control unit 201 controls the transfer power supply 21. That is, the transfer control unit 201 controls the voltage output from the transfer power supply 21 on the basis of a current value detected by a current detecting circuit (not illustrated). Upon receiving image information and a print command from a host computer (not illustrated), the controller 100 controls the control units (i.e., the development control unit 202, the exposure control unit 203, and the charge control unit 204) and performs an image forming operation needed for the print operation.

The intermediate transfer belt 10, the stretching members 11, 12, and 13, and a contact member 14 are described in more detail next.

The intermediate transfer belt 10 serving as the intermediate transfer member is disposed so as to face each of the image forming stations a to d. The intermediate transfer belt 10 is a conductive endless belt formed by adding a conducting agent to a resin material in order to provide conductivity. The intermediate transfer belt 10 is entrained around three axes, that is, the three stretching members. The three stretching members are a drive roller 11, a tension roller 12, and a secondary transfer counter roller 13. The tension roller 12 tensions the intermediate transfer belt 10 by a force of 60 N. The intermediate transfer belt 10 is driven and rotated by the drive roller 11 which is driven and rotated by a drive source (not illustrated). The intermediate transfer belt 10 moves in the same direction at substantially the same circumferential speed as the circumferential speed of the photoconductor drums 1*a*, 1*b*, 1*c*, and 1*d* when viewed at positions at which the intermediate transfer belt 10 faces the photoconductor drums 1*a*, 1*b*, 1*c*, and 1*d*. Hereinafter, part of the surface of the intermediate transfer belt 10 that is located between the two stretching members (the secondary transfer counter roller 13 and the drive roller 11) and that allows a toner image to be primarily transferred from each of the photoconductor drums 1*a*, 1*b*, 1*c*, and 1*d* thereto is referred to as a "primary transfer surface M".

A plurality of contact members are provided so as to be in contact with the intermediate transfer belt 10 at positions at which the intermediate transfer belt 10 faces the photoconductor drums 1*a*, 1*b*, 1*c*, and 1*d*. According to the present exemplary embodiment, the primary transfer members (metal rollers 14*a*, 14*b*, 14*c*, and 14*d*) are used as the contact members. Each of the metal rollers 14*a*, 14*b*, 14*c*, and 14*d* is disposed so as to be spaced away from the primary transfer section, which is formed by the corresponding photoconductor drum and the intermediate transfer belt, in the downstream direction.

Figure 3:
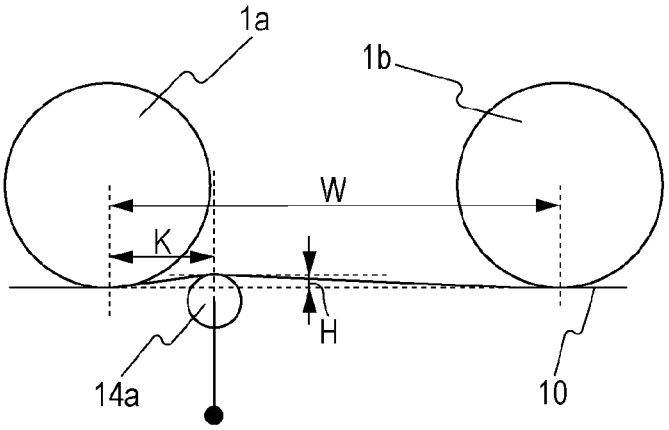
FIG. 3 illustrates the structure of a primary transfer section according to the first exemplary embodiment.

The structure of each of the metal rollers 14*a*, 14*b*, 14*c*, and 14*d* is described in detail below with reference to FIG. 3. FIG. 3 is an enlarged view of the structure of the first image forming station an illustrated in FIG. 1. As illustrated in FIG. 3, the metal roller 14*a* is disposed so as to be spaced away from the center of the photoconductor drum 1*a* toward the downstream side in the movement direction of the intermediate transfer belt 10 by 8 mm. In addition, in order to provide a proper amount of wrap of the intermediate transfer belt 10 around the photoconductor drum 1*a*, the metal roller 14*a* is located so that the ends of a shaft of the metal roller 14*a* in the longitudinal direction are raised from a horizontal plane formed by the photoconductor drum 1*a* and the intermediate transfer belt 10 by 1 mm.

The reason the metal roller 14*a* is spaced away from the primary transfer section is that if the photoconductor drum 1*a* is in contact with the metal roller 14*a* (with the intermediate transfer belt 10 therebetween), the metal roller 14*a*, which is a rigid body, damages the photoconductor drum and, thus, the durability of the photoconductor drum is decreased. In addition, if a transfer electric field is generated upstream of the primary transfer section, a scattering effect in which the toner image on the photoconductor drum moves to a position that differs from a predetermined transfer position may occur. Accordingly, the metal roller 14*a* is disposed so as to be spaced away from the primary transfer section in the downward direction.

Let W denote the distance between the photoconductor drum 1*a* of the first image forming station a and the photoconductor drum 1*b* of the second image forming station b, K denote the offset of the metal roller 14*a* from the primary transfer section, and H denote the lifting height of the metal roller 14*a* from the intermediate transfer belt 10. Then, according to the present exemplary embodiment, W=60 mm, K=8 mm, and H=1 mm. Note that the metal roller 14*a* is formed from a straight nickel-plated SUS round bar having an outer diameter of 6 mm. The metal roller 14*a* is rotated with the rotation of the intermediate transfer belt 10. The metal roller 14*a* is disposed on the inner circumferential surface side of the intermediate transfer belt 10 and is in contact with a predetermined area of the intermediate transfer belt 10 across the longitudinal direction that is perpendicular to the movement direction of the intermediate transfer belt 10.

Each of the metal roller 14*b* disposed so as to correspond to the second image forming station b, the metal roller 14*c* disposed so as to correspond to the third image forming station c, and the metal roller 14*d* disposed so as to correspond to the fourth image forming station d has the same structure as that of the metal roller 14*a*.

According to the present exemplary embodiment, the intermediate transfer belt 10 has a circumferential length of 700 mm and a thickness of 90 μm. The intermediate transfer belt 10 is formed as an endless belt made of polyimide resin mixed with carbon serving as a conducting agent. The intermediate transfer belt 10 has electronically conductive properties. A variation in a resistance value of the intermediate transfer belt 10 with respect to a temperature and a humidity of the atmosphere is small. While the present exemplary embodiment has been described with reference to the material of the intermediate transfer belt 10 formed of polyimide resin, the material is not limited thereto. Any thermoplastic resin may be employed as the material of the intermediate transfer belt 10. For example, the following materials may be employed: polyester, polycarbonate, polyarylate, acrylonitrile butadiene styrene (ABS) copolymer, polyphenylene sulfide (PPS), polyvinylidene fluoride (PVdF), or a mixed resin thereof. Note that instead of carbon, fine conductive metal oxide particles can be employed as the conducting agent.

According to the present exemplary embodiment, the intermediate transfer belt 10 has a volume resistivity of $1\times10^9$ Ω·cm. To measure the volume resistivity, Hiresta-UP (MCP-HT450) and a UR-type ring probe (model number: MCP-HTP12) available from Mitsubishi Chemical Corporation is used. In measurement, the room temperature is set to 23° C., and the room humidity is set to 50%. The applied voltage is 100 V, and the measurement time is 10 sec. According to the present exemplary embodiment, the volume resistivity of the intermediate transfer belt 10 may range from $1\times10^{7}$ Ω·cm to $3\times10^{11}$ Ω·m. In a structure in which as in the present exemplary embodiment, the contact member 14 serving as the primary transfer member is disposed so as to be spaced away from the primary transfer section, it is desirable that the intermediate transfer belt 10 allow an electric current to easily flow from the contact portion in which the contact member 14 is in contact with the intermediate transfer belt 10 to primary transfer section. Herein, the volume resistivity is an index of the conductivity of the material of the intermediate transfer belt. The value of the electrical resistance in the circumferential direction is an important factor for determining whether the belt can actually generate a desired primary transfer potential by passing an electric current in the circumferential direction (hereinafter, such a belt is referred to as a "conductive belt").

Figure 4A:
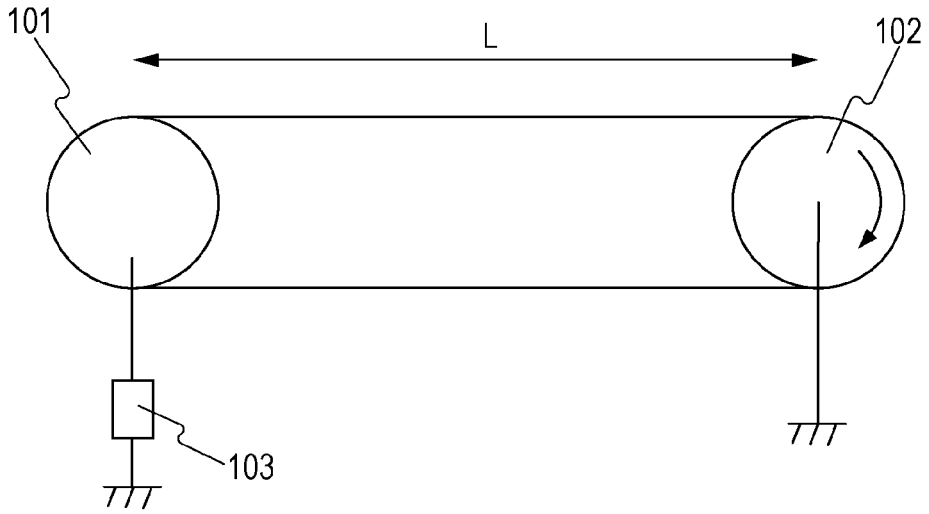
FIGS. 4A and 4B illustrate a measuring system that measures the resistance of an intermediate transfer belt in the circumferential direction.

Therefore, according to the present exemplary embodiment, the value of the resistance of the intermediate transfer belt 10 in the circumferential direction was measured using a circumferential-direction resistance measuring tool illustrated in FIG. 4A. An apparatus to be measured is described first. The intermediate transfer belt 10 to be measured is entrained around an inner surface roller 101 and a drive roller 102 with any slack removed. The inner surface roller 101 is formed of metal. The inner surface roller 101 was connected to a high-voltage power source 103 (Model 610E available from TREK, INC.) The drive roller 102 is connected to ground. The surface of the drive roller 102 is coated by a conductive rubber having a sufficiently low resistance with respect to the intermediate transfer belt 10. The drive roller 102 rotates so that the intermediate transfer belt 10 rotates at a speed of 100 mm/sec.

Figure 4B:
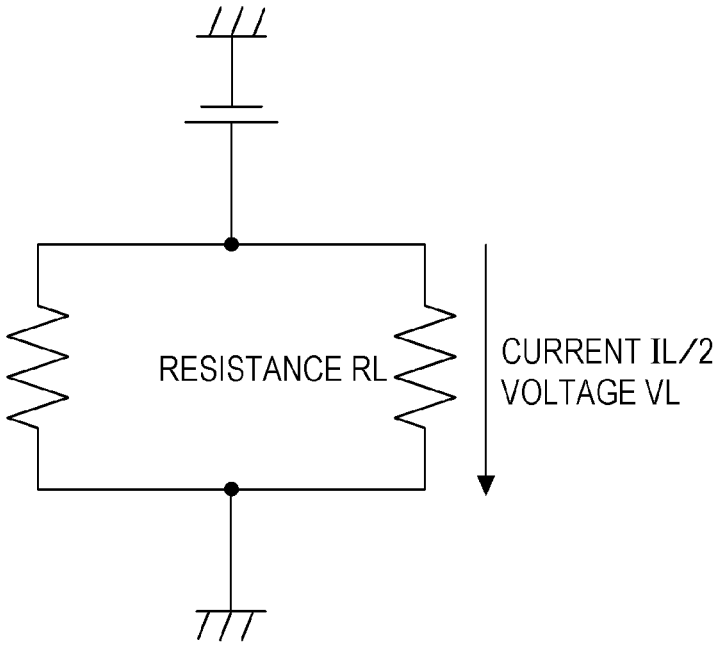

A method for measuring the value of the resistance of the intermediate transfer belt 10 is described next. The intermediate transfer belt 10 is rotated by the drive roller 102 at a speed of 100 mm/sec, and a constant current IL is applied to the inner surface roller 101. At that time, a voltage VL is monitored by the high-voltage power source 103 connected to the inner surface roller 101. FIG. 4B is an equivalent circuit of a measuring system illustrated in FIG. 4A. A resistance RL of the intermediate transfer belt 10 for a distance L between the inner surface roller 101 and the drive roller 102 (300 mm according to the present exemplary embodiment) in the circumferential direction can be computed by using the following equation:

$$RL=2VL/IL.$$

By converting RL into a resistance for the 100-mm circumferential length of the intermediate transfer belt 10, the resistance in the circumferential direction can be obtained. In the structure according to the present exemplary embodiment, that is, in the structure in which the metal roller is disposed so as to be spaced away from the primary transfer section in the downstream direction, it is desirable that the conductive belt have a resistance of $1\times10^{9}$Ω or less in the circumferential direction.

In general, the voltage output from the secondary transfer power supply used for secondary transfer (i.e., the secondary transfer voltage) is about five to ten times higher than the voltage output from the primary transfer power supply used for primary transfer (i.e., the primary transfer voltage). To continuously form images on a plurality of the recording media, primary transfer onto a subsequent one of the recording media is needed during secondary transfer onto the preceding one of the recording media. Accordingly, it is difficult to cause the primary transfer member and the secondary transfer member to have optimum potentials using a single transfer power supply.

Thus, a configuration for causing the primary transfer member and the secondary transfer member to have optimum potentials using a single transfer power supply is described next.

In the configuration according to the present exemplary embodiment, the transfer power supply 21 that applied a voltage to the secondary transfer roller 20 is used to maintain the potentials of the metal rollers 14*a*, 14*b*, 14*c*, and 14*d*. That is, the transfer power supply 21 is a transfer power supply common to primary transfer and secondary transfer. The secondary transfer counter roller 13 (the secondary transfer counter member) faces the secondary transfer member (the secondary transfer roller 20) with the intermediate transfer belt therebetween, and the secondary transfer member has a voltage applied from the transfer power supply 21. The secondary transfer counter roller 13 is grounded via a voltage maintenance element 15. The metal rollers 14*a*, 14*b*, 14*c*, and 14*d* are connected to the voltage maintenance element 15. The members to which the voltage maintenance element 15 is connected (i.e., the secondary transfer counter roller 13 and the metal rollers 14*a*, 14*b*, 14*c*, and 14*d*) are maintained at a predetermined potential or higher by passing a current from the secondary transfer roller 20 serving as a current supply member to the voltage maintenance element 15 via the intermediate transfer belt 10.

Herein, the predetermined potential is set so that each of primary transfer sections can maintain the primary transfer potentials that can provide desired transfer efficiency. According to the present exemplary embodiment, a zener diode 15, which is a constant voltage element, is used as the voltage maintenance element 15.

As used herein, a voltage applied between the anode and the cathode of the zener diode 15 when a backward voltage is applied to the zener diode 15 is referred to as a "zener voltage". When a plurality of the zener diodes are connected in series, the voltage maintained by the cathode of the zener diode that is the closest to the connection point is defined as a "zener voltage".

Figure 5:
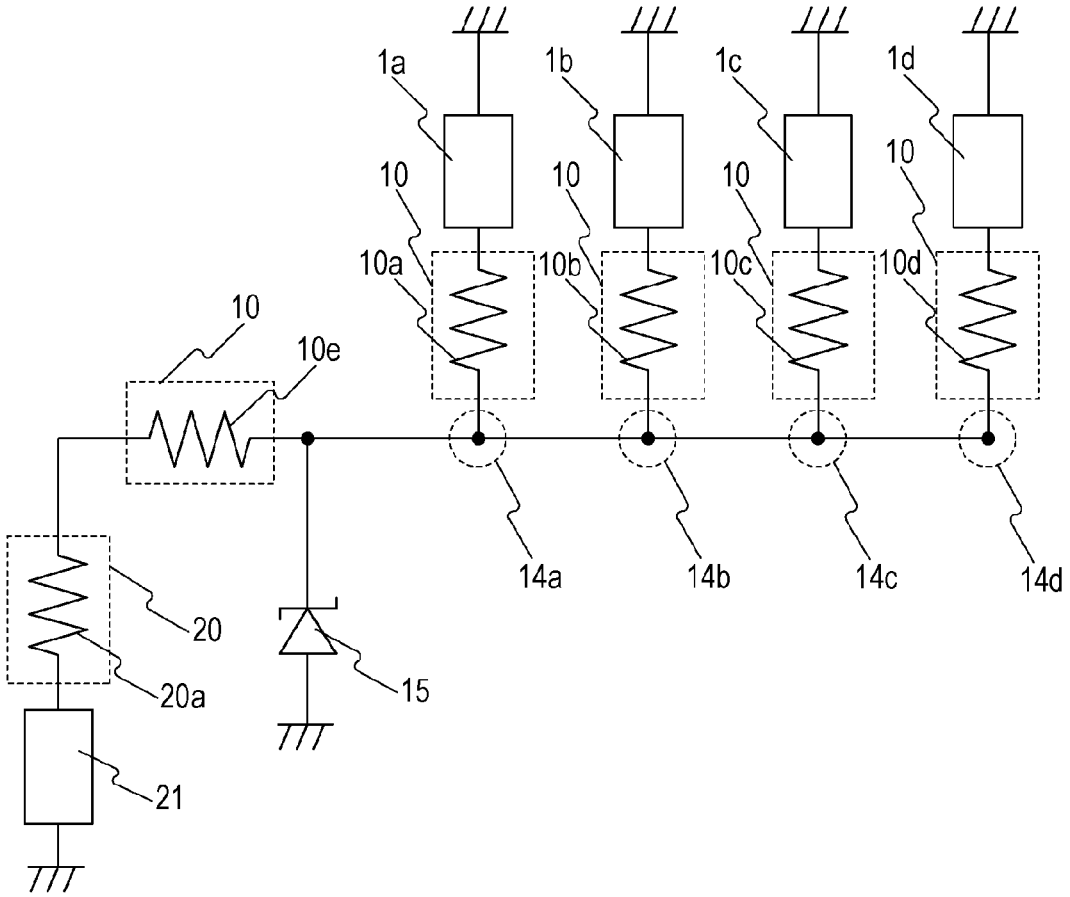
FIG. 5 is a schematic illustration of an electric current path in the image forming apparatus according to the first exemplary embodiment.

FIG. 5 is a schematic illustration of a current path of a current flowing from the transfer power supply 21 to the metal rollers 14*a*, 14*b*, 14*c*, and 14*d* in the image forming apparatus illustrated in FIG. 1. Hereinafter, the resistance of the secondary transfer roller 20 is referred to as a "second transfer roller resistance 20*a*", and part of the intermediate transfer belt 10 sandwiched by the secondary transfer roller 20 and the secondary transfer counter roller 13 in the volume direction is referred to as a "resistance 10*e*". In addition, parts of the intermediate transfer belt 10 sandwiched by the metal rollers 14*a*, 14*b*, 14*c*, and 14*d* and the photoconductor drums 1*a*, 1*b*, 1*c*, and 1*d*, respectively, in the circumferential direction are referred to as resistances 10*a*, 10*b*, 10*c*, and 10*d*, respectively. The voltage applied from the transfer power supply 21 to the secondary transfer roller 20 is set to a voltage optimum to secondary transfer performed in the secondary transfer section. According to the present exemplary embodiment, the secondary transfer voltage is 1600 V.

The secondary transfer voltage applied from the transfer power supply 21 to the secondary transfer roller 20 is divided by the second transfer roller resistance 20*a* and the resistance 10*e* of the intermediate transfer belt 10 in the volume direction. At that time, part of a current generated by the secondary transfer voltage applied from the transfer power supply 21 to the secondary transfer roller 20 flows toward the zener diode 15 via the secondary transfer roller resistance 20*a* and the resistance 10*e* of the intermediate transfer belt 10 in the volume direction. At that time, since the zener diode 15 allows the current to flow from the cathode to the anode, a backward voltage is applied. Since the anode of the zener diode 15 is grounded, the cathode of the zener diode 15 is maintained at the zener voltage. Accordingly, when the zener diode 15 is maintained at the zener voltage (300 V according to the present exemplary embodiment), the metal rollers 14*a*, 14*b*, 14*c*, and 14*d* connected to the zener diode 15 are also maintained at the zener voltage. As a result, the primary transfer potential (200 V according to the present exemplary embodiment) that can provide the desired transfer efficiency in each of primary transfer sections can be generated.

Figure 6:
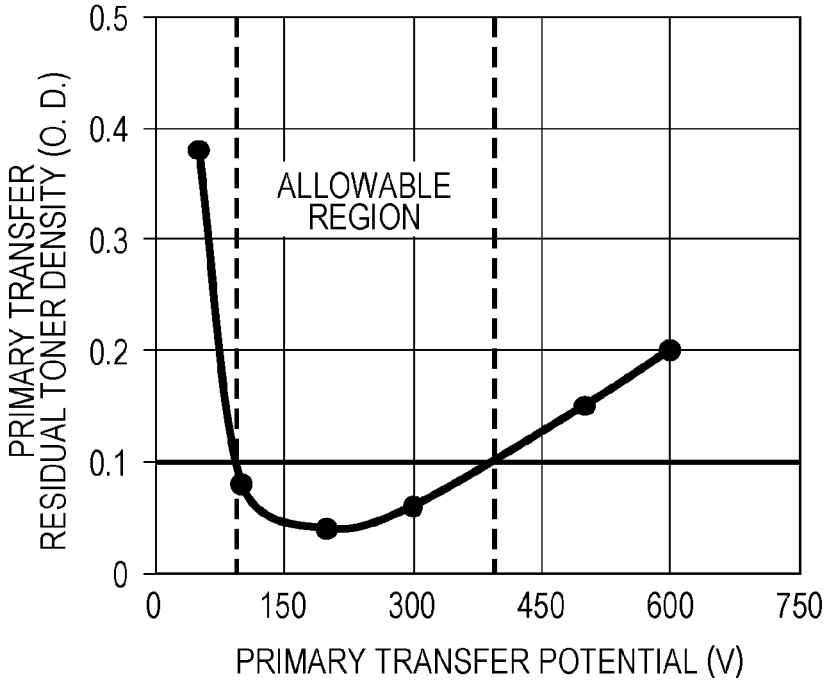
FIG. 6 illustrates a relationship between a primary transfer potential and a transfer efficiency according to the first exemplary embodiment.
Figure 7:
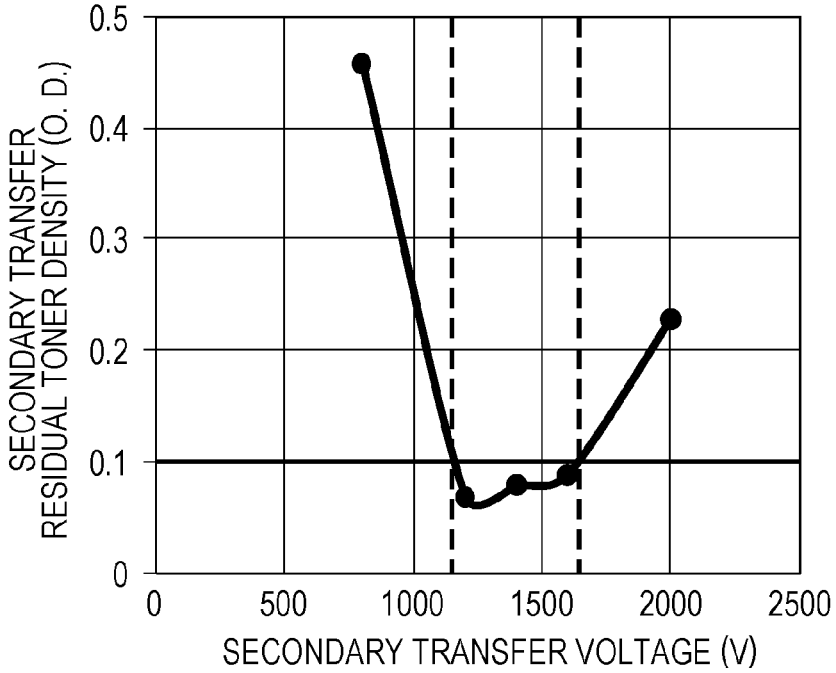
FIG. 7 illustrates a relationship between a secondary transfer potential and the transfer efficiency according to the first exemplary embodiment.

FIG. 6 illustrates a primary transfer potential and the transfer efficiency in the primary transfer section. The transfer efficiency value in the ordinate indicates a measurement value obtained using a Macbeth transmission reflection densitometer available from Gretag-Macbeth LLC. As the transfer efficiency value increases, the primary transfer residual toner density increases and, thus, the transfer efficiency decreases. In the configuration according to the present exemplary embodiment, as indicated by a graph illustrated in FIG. 6, a region in which the primary transfer efficiency is excellent (a region in which the transfer efficiency of 95% or higher is achieved) requires the primary transfer potential ranging from 100 V to 400 V. In contrast, in FIG. 7, the secondary transfer voltage and the transfer efficiency in the secondary transfer section are illustrated. As illustrated in FIG. 7, a region in which the secondary transfer efficiency is acceptable (a region in which the transfer efficiency of 95% or higher is achieved) requires a secondary transfer voltage ranging from 1100 V to 1600 V.

As described above, according to the present exemplary embodiment, the secondary transfer voltage that satisfies the secondary transferability (i.e., 1600 V) can be applied from the transfer power supply 21 to the secondary transfer roller 20. At the same time, by using the voltage maintenance element 15, the primary transfer potential that satisfies the transferability in each of the primary transfer sections (i.e., 200 V) can be generated.

Figure 8:
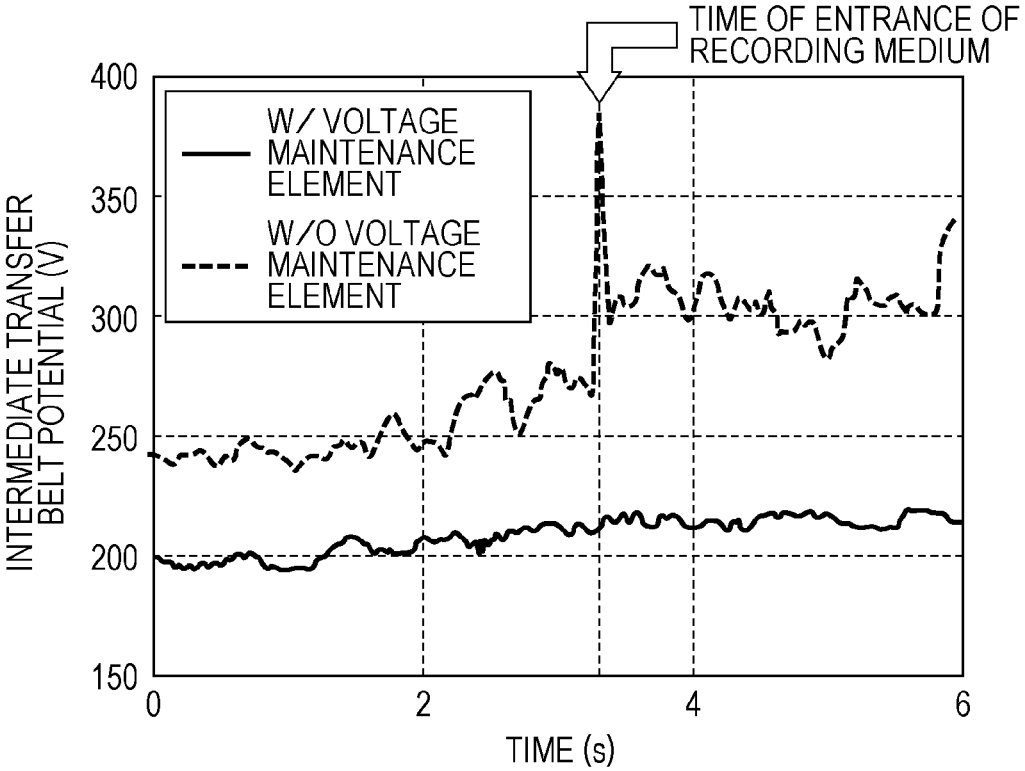
FIG. 8 illustrates a variation in the potential of an intermediate transfer belt in a primary transfer section of a first image forming station occurring before and after a recording medium enters a secondary transfer section.

Instead of the constant voltage control, the transfer power supply 21 may perform constant current control so that the current flowing through the secondary transfer roller 20 is constant. By performing the constant current control, a potential difference between the surface of a recording medium and the surface of the belt can be maintained even when the resistance of the recording medium varies. Thus, secondary transfer can be performed with a proper secondary transfer potential difference. In addition, by connecting the zener diode 15 to the secondary transfer counter roller 13, a variation in the potential of the intermediate transfer belt 10 occurring at the time of entrance of the recording medium P can be reduced. FIG. 8 illustrates the result of measurement of a variation in the potential of the primary transfer section of the first image forming station occurring before and after the recording medium P enters the secondary transfer section. In FIG. 8, the ordinate represents the potential in the primary transfer section of the first image forming station, and the abscissa represents an elapsed time. The voltage applied to the intermediate transfer belt 10 during a secondary transfer process in the configuration according to the present exemplary embodiment was measured. The voltage was measured using a surface electrometer (Model 1370 available from TREK, INC.) and a dedicated probe (Model 3800S-2). By connecting the zener diode 15 to the secondary transfer counter roller 13 and monitoring the potential of a metal roller (not illustrated) disposed at a position facing the secondary transfer counter roller 13 via the intermediate transfer belt 10, the surface potential of the intermediate transfer belt 10 was measured.

A dotted line in FIG. 8 indicates the potential when the zener diode 15 is not connected. A solid line in FIG. 8 indicates the potential when the zener diode 15 is connected. If the constant current control is performed when the recording medium P enters the secondary transfer section, an amount of current supplied from the secondary transfer roller 20 instantaneously increases. At that time, an excess amount of current supplied from the secondary transfer roller 20 can be led to the zener diode 15 via the intermediate transfer belt 10 and the secondary transfer counter roller 13. Accordingly, the surface potential of the intermediate transfer belt 10 can be stably set to 200 V. In contrast, if the zener diode 15 is not connected, it is difficult to obtain the above-described effect. Accordingly, the intermediate transfer belt potential in the primary transfer section of the first image forming station varies.

In this manner, by connecting the zener diode 15 to the secondary transfer counter roller 13, the intermediate transfer belt potential in the primary transfer section of the first image forming station can be maintained constant even when the secondary transfer current varies at the time of arrival of a recording medium at the secondary transfer section.

In addition, according to the present exemplary embodiment, the power can be supplied to the photoconductor drums 1*a*, 1*b*, 1*c*, and 1*d* from a point within a short distance therefrom. Accordingly, the area of the intermediate transfer belt 10 in which the resistance is high can be also used.

Furthermore, if the photoconductor drums 1*a*, 1*b*, 1*c*, and 1*d* are used for a long time, the surface of the photoconductor drum is degraded due to electrical discharge from the charge roller 2. In addition, since the surface of the photoconductor drum is in slide contact with the cleaning device 5, the surface of the photoconductor drum is scraped and, therefore, the film thickness of the surface is decreased. At that time, if the photoconductor drums having different use conditions (e.g., the accumulated number of rotations) are used together, the film thicknesses of the photoconductor drums are not the same. In such a case, if a constant charging voltage Vcdc is applied to the plurality of photoconductor drums, the potential differences occurring in air gaps between each of the charge rollers 2 and the corresponding photoconductor drum 1 differ from one another, in general. Thus, charged potentials Vd on the surfaces of the photoconductor drums 1 differ from one another. If the charged potentials Vd on the surfaces of the photoconductor drums 1 differ from one another, the transfer contrasts (potential differences between each of the photoconductor drums 1 and the intermediate transfer belt 10 in the primary transfer sections) disadvantageously differ from one another.

The variation in the charged potentials Vd can be corrected by changing the potentials in the primary transfer sections in accordance with the variation. However, according to the configuration of the present exemplary embodiment, it is difficult to set the potential in each of the image forming stations to any desired value.

Therefore, by changing the charged voltage of each of the charge rollers 2*a*, 2*b*, 2*c*, and 2*d* in accordance of the use environment and use conditions of the charge roller using the controller 100, the charged potentials Vd of the surfaces of the photoconductor drums can be made the same. In this manner, a proper primary transfer contrast can be maintained in each of the primary transfer sections.

Alternatively, if a charging power supply that is common to all of the charge rollers and that outputs a voltage to the charge rollers is employed in order to reduce the manufacturing cost, the exposure units 3*a*, 3*b*, 3*c*, and 3*d* may be controlled using the controller 100. By uniformly exposing non-image areas of the photoconductor drums 1*a*, 1*b*, 1*c*, and 1*d* using weak exposure light output from the exposure units 3*a*, 3*b*, 3*c*, and 3*d* when the electrostatic latent images are formed in accordance with the image signal, the photoconductor drum potential can be stabilized.

Figure 9:
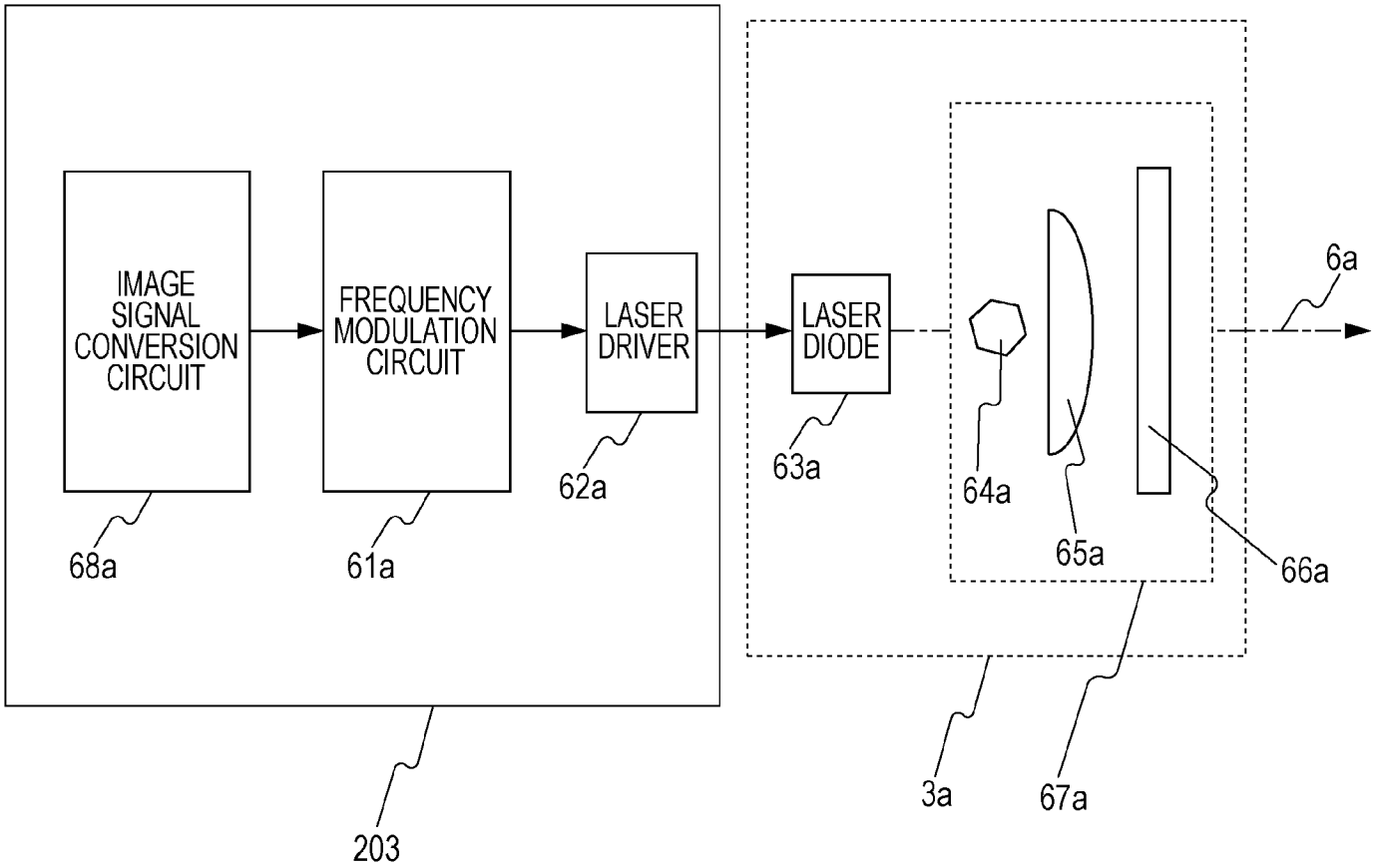
FIG. 9 illustrates an exposure control unit and an exposure unit.

The weak exposure of the non-image areas is described below with reference to the exposure unit 3*a* of the first image forming station an illustrated in FIG. 9. As illustrated in FIG. 9, the image signal sent from the controller 100 is an 8-bit multiple-valued signal (0 to 255) having a 256-tone. If the value of the image signal is "0", a laser beam is turned off. If the value of the image signal is "255", a laser beam is fully turned on. If the value of the image signal is in the range between 1 and 254, the level of the laser beam is between the two. In such a case, the non-image area exposure level can be set to any level in accordance with the level of the multiple-valued signal. In the following description, non-image area exposure is performed using the multiple-valued signal having a level of 32. The level of a non-image area indicated by the image signal having a level of 0 sent from the controller 100 is converted into 32 by an image signal conversion circuit 68*a* of the exposure control unit 203. In addition, the levels of non-image areas indicated by the image signals having levels from 1 to 255 are compression-converted into 33 to 255. Subsequently, the signal is converted into a serial signal in the time axis direction by the frequency modulation circuit 61*a*. According to the present exemplary embodiment, the signal is used for pulse width modulation of each of dot pulses for a resolution of 600 dot/inch.

By using such a signal, a laser driver 62*a* is driven, and a laser diode 63*a* is turned on. Thus, a laser beam 6*a* is emitted. The laser beam 6*a* travels through a correction optical system 67*a* including a polygon mirror 64*a*, a lens 65*a*, and a folding mirror 66*a*. Thereafter, the laser beam 6*a* is emitted onto the photoconductor drum 1*a* as a scanning light beam. Note that a frequency modulation circuit 61*a* may be separated from the laser driver 62*a* and may be disposed on the controller side.

By exposing a non-image area to light in this manner, the photoconductor drum potential can be stabilized. Thus, even when the film thickness of each of the photoconductor drums is varied, excellent primary transfer can be performed.

Figure 10:
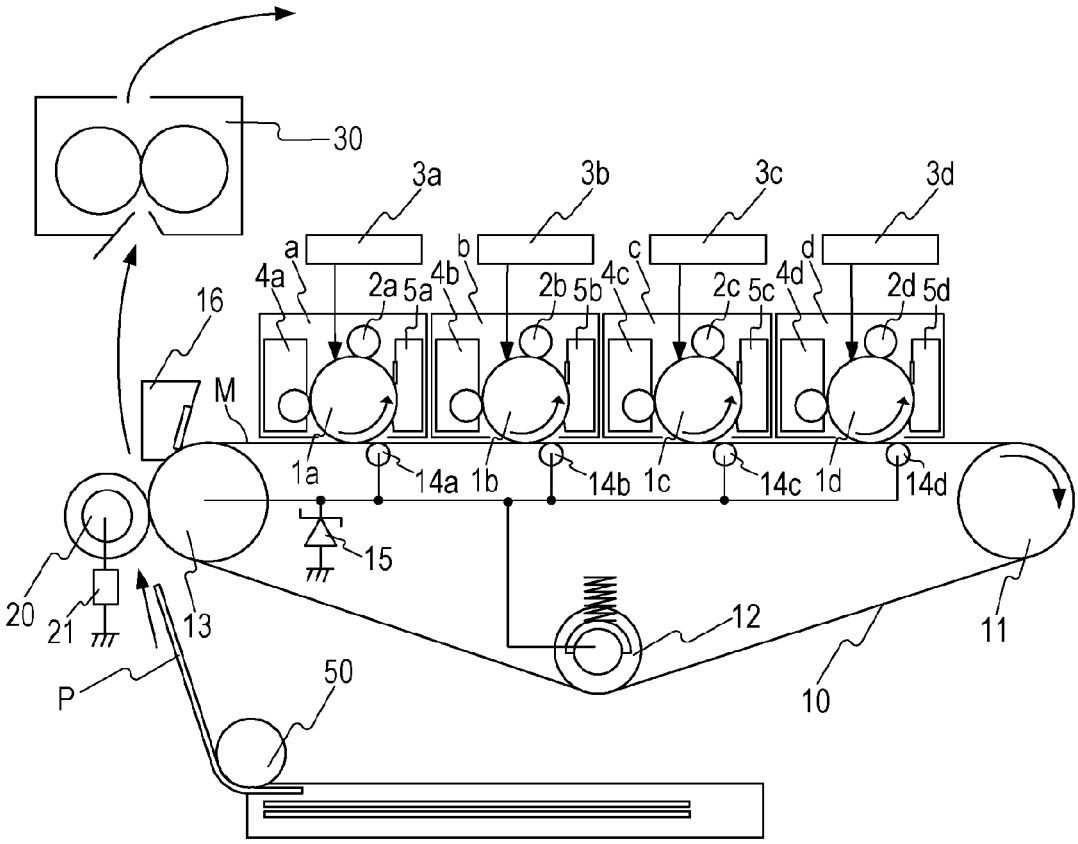
FIG. 10 illustrates another example of the configuration according to the first exemplary embodiment.

A configuration in which as illustrated in FIG. 10, a voltage maintenance element is connected to the secondary transfer counter roller 13 can provide the same advantages. Herein, the secondary transfer counter roller 13 is one of the stretching members and faces the secondary transfer roller 20, which has a voltage applied from the transfer power supply 21, via the intermediate transfer belt 10.

While the present exemplary embodiment has been described with reference to a nickel-plated SUS as the material of the contact member 14, the material is not limited thereto. For example, the material of the contact member 14 may be aluminum, the other metals (such as iron), or a conductive resin that forms a conductive roller. Alternatively, a member including a metal roller coated with an elastic film can provide the same advantages.

Figure 11:
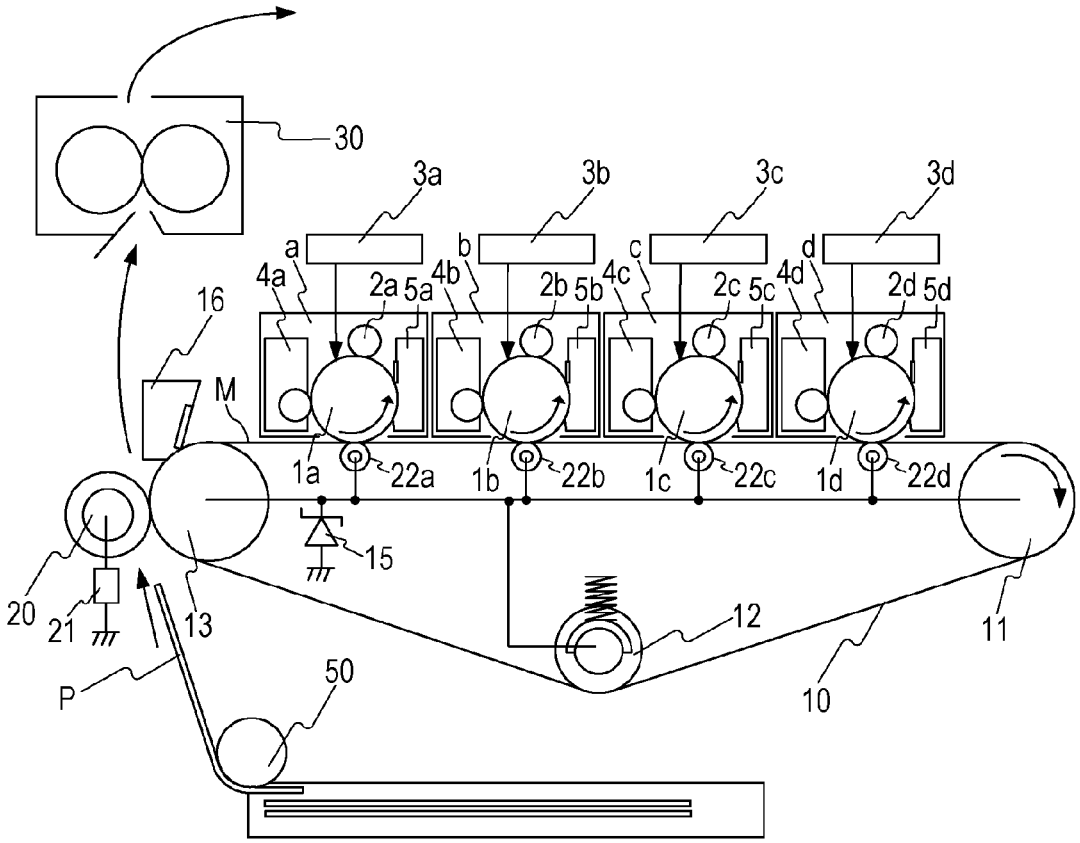
FIG. 11 illustrates still another example of the configuration according to the first exemplary embodiment.

FIG. 11 illustrates an image forming apparatus including conductive elastic rollers 22*a*, 22*b*, 22*c*, and 22*d* serving as the primary transfer members. Note that the outer diameter of each of the elastic rollers 22*a*, 22*b*, 22*c*, and 22*d* is 12 mm. Each of the elastic rollers 22*a*, 22*b*, 22*c*, and 22*d* includes a nickel-plated steel bar that is covered by a foam sponge member consisting primarily of nitrile butadiene rubber (NBR) and an epichlorohydrin rubber. The nickel-plated steel bar has an outer diameter of 6 mm. The thickness of the foam sponge member is set to 3 mm. The foam sponge member has a volume resistivity of $10^5$ Ω·cm. The elastic rollers 22*a*, 22*b*, 22*c*, and 22*d* are in pressure contact with the photoconductor drums 1*a*, 1*b*, 1*c*, and 1*d* with the intermediate transfer belt 10 therebetween, respectively. The applied pressure is 9.8 N. The elastic rollers 22*a*, 22*b*, 22*c*, and 22*d* are rotated by the rotation of the intermediate transfer belt 10. When, as illustrated in FIG. 11, a conductive roller is employed, the primary transfer member can be disposed immediately beneath the primary transfer section. Such a configuration can employ an intermediate transfer belt having a resistance higher than that in the configuration in which the metal roller 14 is disposed downstream of the primary transfer section.

While the present exemplary embodiment has been described with reference to the zener diode 15, which is a constant voltage source, as the voltage maintenance element, any device that provides the same advantages (e.g., a varistor) may be employed. Alternatively, instead of employing a constant voltage element, a resistance device that can maintain the potential of the connected member for a predetermined period of time or longer may be employed as the voltage maintenance element, although management of the potential is more difficult than a constant voltage element since the potential varies in accordance with the amount of a current flowing in the resistance element. For example, a 100-MSΩ resistance element may be employed.

Figure 12:
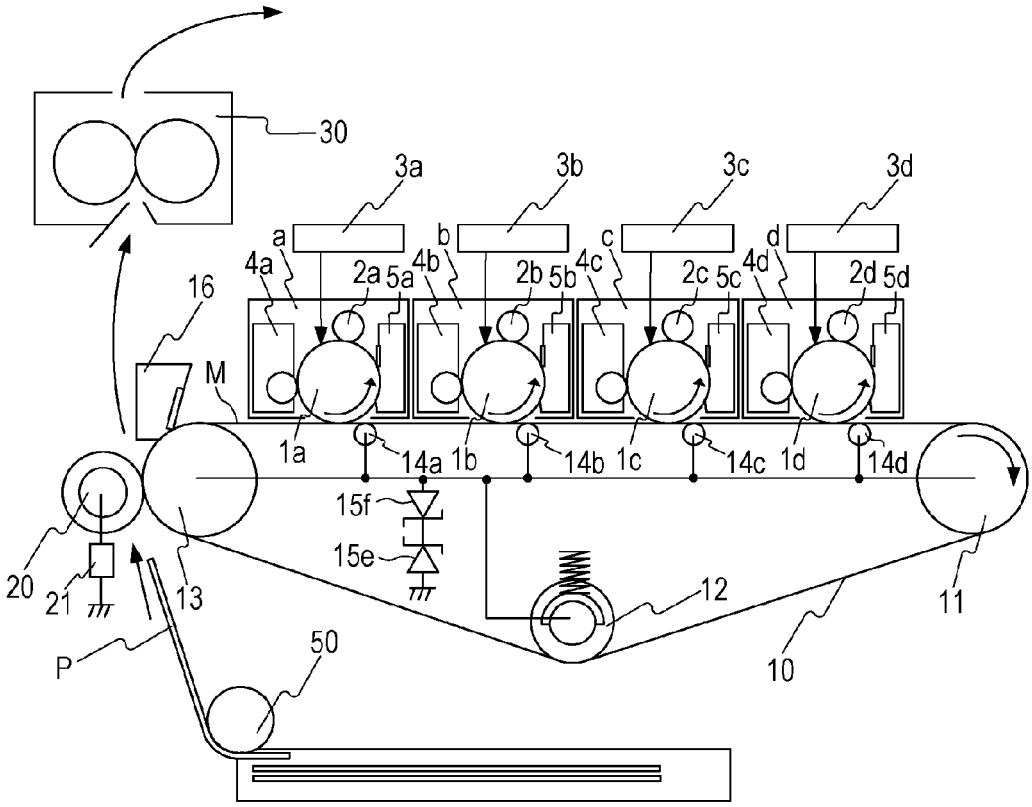
FIG. 12 illustrates yet still another example of the configuration according to the first exemplary embodiment.

In addition, a voltage having a negative polarity (the polarity that is the same as the normal charge polarity of toner) can be applied from the transfer power supply 21 to the secondary transfer member. In such a case, in an image forming apparatus illustrated in FIG. 12, by applying a voltage having the negative polarity from the transfer power supply 21, the contact member 14 can have a potential of the negative polarity. The image forming apparatus illustrated in FIG. 12 has a configuration in which two zener diodes 15*f* and 15*e* are connected in series. More specifically, the anode of the zener diode 15*e* having a zener voltage of 200 V and serving as the voltage maintain device 15 is grounded. The cathode of the zener diode 15*e* is connected to the anode of the zener diode 15*f*, and the cathode of the zener diode 15*f* is connected to the secondary transfer counter roller 13 and the metal rollers 14. The zener diode 15*f* has a zener voltage of 200 V. If the zener diode 15*e* is called a first zener diode, the zener diode 15*f* is a second zener diode. The second zener diode is reversely connected to the first zener diode.

As in the case in which a voltage of a positive polarity is applied, when a voltage of a negative polarity is applied and if a predetermined amount of current or more flows through the zener diode 15*f*, the zener diode 15*f* maintains 200 V. In this manner, a voltage of a negative polarity can be applied to the secondary transfer member and, at the same time, the potential of the primary transfer section can be maintained at negative polarity.

Second Exemplary Embodiment

In the first exemplary embodiment, the metal rollers 14*a*, 14*b*, 14*c*, and 14*d* serving as the primary transfer members are connected to a single voltage maintenance element. In contrast, according to the present exemplary embodiment, at least one of metal rollers 14*a*, 14*b*, 14*c*, and 14*d* serving as the primary transfer members is connected in the middle of a plurality of voltage maintenance elements connected in series. Note that the other structures are the same as those of the image forming apparatus according to the first exemplary embodiment. Accordingly, the same reference symbols are used to indicate elements which are the same or which perform the same or a similar function to the element of the first exemplary embodiment, and descriptions of the elements are not repeated.

Figure 13:
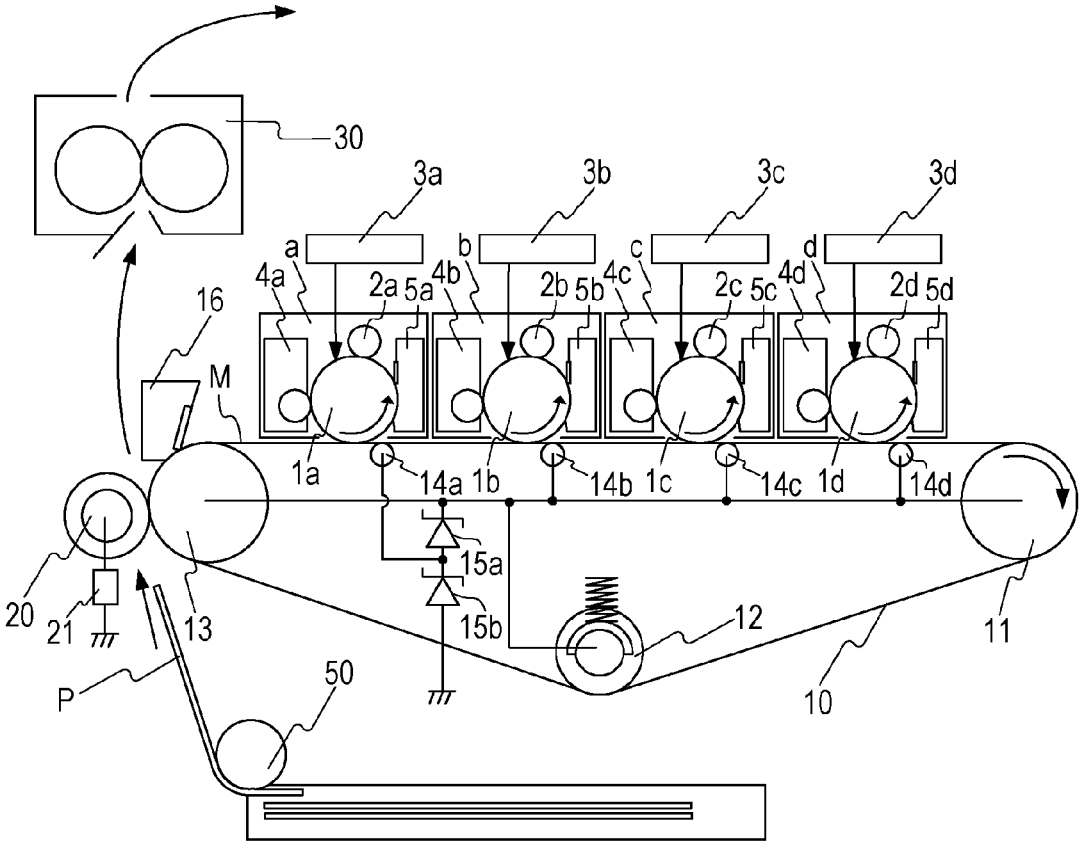
FIG. 13 is a schematic illustration of an image forming apparatus according to a second exemplary embodiment.

FIG. 13 is a schematic illustration of an image forming apparatus according to the present exemplary embodiment. According to the present exemplary embodiment, zener diodes 15*a* and 15*b* which are constant voltage elements and serve as the voltage maintenance elements are connected in series. More specifically, the anode of the zener diode 15*b* is grounded. The cathode of the zener diode 15*b* is connected to the anode of the zener diode 15*a*. The anode of the zener diode 15*a* is also connected to the primary transfer member 14*a*. In addition, the secondary transfer counter roller 13 and the primary transfer members 14*b*, 14*c*, and 14*d* are connected to the cathode of the zener diode 15*b*.

The zener diode 15*b* serving as one of the constant voltage elements has a zener voltage of 200 V, and the zener diode 15*a* serving as the other constant voltage element has a zener voltage of 50 V.

When a voltage of positive polarity is applied from the transfer power supply 21 to the secondary transfer roller 20, a constant current flows from the secondary transfer roller 20 to the zener diode 15*b* and the zener diode 15*a* via the intermediate transfer belt 10 and the secondary transfer counter roller 13. At that time, the zener voltages of the zener diodes 15*a* and 15*b* are maintained. The metal roller 14*a* (i.e., one of the primary transfer members) connected to the cathode of the zener diode 15*b* is maintained at 200 V. Since the metal rollers 14*b*, 14*c*, and 14*d* (i.e., the other primary transfer members) are connected to the cathode of the zener diode 15*b*, the metal rollers 14*b*, 14*c*, and 14*d* can be maintained at 250 V (the sum of the two zener voltages).

By employing such a configuration, a voltage maintained by each of the primary transfer members can be appropriately controlled in the primary transfer section. For example, the transfer contrast in each of the image forming stations b, c, and d may be set to lower than that of the first image forming station a located in the most upstream position. Alternatively, the transfer contrasts of the image forming stations may be sequentially increased toward downstream.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-085029 filed Apr. 3, 2012 and No. 2013-050225 filed Mar. 13, 2013, which are hereby incorporated by reference herein in their entirety.

What is claimed is:

1. An image forming apparatus comprising:

an image bearing member configured to bear a toner image;

a movable endless conductive intermediate transfer belt configured to allow the toner image to be primarily transferred from the image bearing member onto the intermediate transfer belt;

a primary transfer member configured to primarily transfer the toner image from the image bearing member onto the intermediate transfer belt, wherein the primary transfer member contacts with inner periphery of the intermediate transfer belt and faces to the image bearing member through the intermediate transfer belt;

a secondary transfer member in contact with the intermediate transfer belt, wherein the secondary transfer member forms a secondary transfer section together with the intermediate transfer belt;

a secondary transfer counter member disposed to face the secondary transfer member with the intermediate transfer belt between the secondary transfer counter member and the secondary transfer member; and a voltage maintenance element having a ground side being electrically grounded and an anti-ground side that is in opposite side of the ground side, and connected to the primary transfer member and the secondary transfer counter member at the anti-ground side, configured to maintain the primary transfer member and the secondary transfer counter member at a predetermined potential or higher with a current flowing from the secondary transfer member through the intermediate transfer belt.

2. An image forming apparatus according to claim 1, wherein the primary transfer member and the secondary transfer counter member are maintained at the same potential by the voltage maintenance element.

3. An image forming apparatus according to claim 1, wherein the primary transfer member and the secondary transfer counter member are connected to the same voltage maintenance element.

4. An image forming apparatus according to claim 1, wherein a toner image is primarily transferred from the image bearing member onto the intermediate transfer belt by the primary transfer member maintained at the predetermined potential or higher and, simultaneously, a toner image is secondarily transferred from the intermediate transfer belt onto a recording medium using the secondary transfer member.

5. An image forming apparatus according to claim 1, further comprising: a transfer power supply configured to apply a voltage to the secondary transfer member, wherein an electric current flows from the transfer power supply to the voltage maintenance element via the secondary transfer member, the intermediate transfer belt, and the secondary transfer counter member.

6. An image forming apparatus according to claim 1, further comprising: a plurality of stretching members that entrains the intermediate transfer belt therearound, wherein one of the plurality of stretching members is the secondary transfer counter member.

7. An image forming apparatus according to claim 1, wherein the toner image born on the image bearing member has a color, the image forming apparatus further comprising:

another image bearing member configured to bear a toner image in a color different from the color of the toner image born on the image bearing member; and another primary transfer member configured to primarily transfer a toner image from the another image bearing member onto the intermediate transfer belt, wherein the primary transfer member and the another primary transfer member are connected to the same anti-ground side of the voltage maintenance element.

8. An image forming apparatus according to claim 7, wherein each of the primary transfer members is disposed downstream of a primary transfer section formed by corresponding image bearing member and the intermediate transfer belt.

9. An image forming apparatus according to claim 5, wherein the transfer power supply applies a voltage to the secondary transfer member so that a current flowing in the secondary transfer member is a constant current.

10. An image forming apparatus according to claim 1, wherein the voltage maintenance element is a constant voltage element.

11. An image forming apparatus according to claim 10, wherein the voltage maintenance element is a zener diode.

12. An image forming apparatus according to claim 1, wherein the primary transfer member is metal roller.

13. An image forming apparatus according to claim 12, wherein the metal roller is disposed inside an inner circumferential surface of the intermediate transfer belt.

14. An image forming apparatus according to claim 7, further comprising: a plurality of exposure units each exposing one of the image bearing members to light, wherein, when the exposure unit exposes the image bearing member to light and forms an electrostatic latent image, the exposure unit exposes a non-image area of the image bearing member while exposing an image area of the image bearing member.

15. An image forming apparatus according to claim 7, wherein the voltage maintenance element comprises a plurality of zener diodes, and at least two zener diodes among the plurality of zener diodes are connected in series in the same orientation, and wherein some of the primary transfer members are connected between two zener diodes connected in series.

16. An image forming apparatus according to claim 1, wherein the voltage maintenance element comprises a plurality of zener diodes, and the secondary transfer member is capable of supplying an electric current of one of positive polarity and negative polarity to the intermediate transfer belt, and wherein, among the plurality of zener diodes, at least one of the plurality of zener diodes is reversely connected to the other zener diodes.

* * * * *